US006964121B2

(12) United States Patent
Harris

(10) Patent No.: US 6,964,121 B2
(45) Date of Patent: Nov. 15, 2005

(54) ALL TERRAIN VEHICLE MOUNT ASSEMBLY FOR A UTILITARIAN ACCESSORY

(75) Inventor: Gary Harris, Hubbardston, MA (US)

(73) Assignee: Curtis International, Inc., Worcester, MA (US)

( * ) Notice: Subject to any disclaimer, the term of this patent is extended or adjusted under 35 U.S.C. 154(b) by 0 days.

(21) Appl. No.: 10/341,150

(22) Filed: Jan. 13, 2003

(65) Prior Publication Data

US 2004/0148811 A1 Aug. 5, 2004

(51) Int. Cl.[7] ..... E01H 5/04

(52) U.S. Cl. ..... 37/231; 37/235; 172/829; 172/439

(58) Field of Search ..... 37/235, 231; 172/63, 172/795, 829, 439

(56) References Cited

U.S. PATENT DOCUMENTS

| | | | | | |
|---|---|---|---|---|---|
| 1,743,969 | A | | 1/1930 | Heinzen | |
| 2,166,424 | A | | 7/1939 | Coates | 37/42 |
| 2,420,592 | A | | 5/1947 | Gerhardt | 74/573 |
| 2,685,240 | A | | 8/1954 | Wilson et al. | 97/47.1 |
| 2,695,467 | A | | 11/1954 | Woods | 37/144 |
| 2,750,688 | A | * | 6/1956 | Grabow | 172/782 |
| 3,285,625 | A | | 11/1966 | Kruger | 280/479 |
| 3,410,008 | A | | 11/1968 | Standfuss | 37/42 |
| 3,521,926 | A | * | 7/1970 | Brewin et al. | 296/156 |
| 3,615,030 | A | * | 10/1971 | Wuest et al. | 414/462 |
| 3,987,562 | A | | 10/1976 | Deen et al. | 37/42 R |
| 4,215,496 | A | * | 8/1980 | Wehr | 37/407 |
| 4,369,590 | A | | 1/1983 | Miller | 37/231 |
| 4,403,432 | A | | 9/1983 | Biance | 37/235 |
| 4,821,436 | A | | 4/1989 | Slocum | 37/235 |
| 4,907,358 | A | | 3/1990 | Moore | 37/232 |
| 4,924,610 | A | * | 5/1990 | Sodemann | 37/231 |
| 4,955,781 | A | | 9/1990 | Holladay | 414/786 |
| 4,976,054 | A | * | 12/1990 | Jones | 37/235 |
| 4,991,323 | A | | 2/1991 | Benkler | 37/235 |
| 5,088,215 | A | | 2/1992 | Ciula | 37/197 |
| 5,136,795 | A | * | 8/1992 | Rosenberg | 37/233 |
| 5,193,296 | A | | 3/1993 | Reilley | 37/231 |
| 5,235,308 | A | | 8/1993 | Shimada et al. | 337/377 |
| 5,329,708 | A | | 7/1994 | Segorski et al. | 37/231 |
| 5,353,530 | A | | 10/1994 | Pieper | 37/231 |
| 5,381,647 | A | | 1/1995 | Eberle | 56/15.8 |
| 5,393,194 | A | | 2/1995 | Smith | 414/546 |
| 5,435,082 | A | | 7/1995 | Frenette et al. | 37/235 |
| 5,485,690 | A | * | 1/1996 | MacQueen | 37/271 |
| 5,568,694 | A | | 10/1996 | Capra et al. | 37/231 |
| 5,615,745 | A | | 4/1997 | Cross | 172/811 |
| 5,662,451 | A | | 9/1997 | Muzzi et al. | 414/540 |
| 5,666,747 | A | | 9/1997 | MacQueen | 37/273 |
| 5,707,072 | A | | 1/1998 | Hopper | 280/491.5 |
| 5,709,351 | A | * | 1/1998 | Osborn et al. | 242/391.3 |
| 5,778,567 | A | | 7/1998 | Jager et al. | 37/235 |
| 5,909,960 | A | | 6/1999 | Jager et al. | 37/235 |
| 5,947,496 | A | | 9/1999 | Kraft et al. | 280/93.508 |

(Continued)

*Primary Examiner*—Robert E. Pezzuto
*Assistant Examiner*—Thomas A Beach
(74) *Attorney, Agent, or Firm*—Nields & Lemack

(57) ABSTRACT

Hitch mount assembly for snow blades or other accessories or implements for off-road vehicles such as all-terrain vehicles. The assembly includes a receiver for mounting to the vehicle chassis and an implement assembly readily removably coupled to the receiver. The configuration of the receiver and implement assembly allows for self-alignment during the mounting operation. A switching mechanism and actuator also can be used to pivot the working implement remotely. The mount assembly can be attached to the vehicle with a powered winch or manually.

6 Claims, 13 Drawing Sheets

U.S. PATENT DOCUMENTS 5,950,336 A 9/1999 Liebl ..... 37/231
5,975,831 A * 11/1999 Martin ..... 414/543
6,104,099 A 8/2000 Mizuta et al. ..... 307/9.1
6,145,222 A 11/2000 Curtis ..... 37/231
6,178,668 B1 1/2001 Gustafson et al. ..... 37/231
6,231,030 B1 * 5/2001 Smith ..... 254/324
6,257,347 B1 * 7/2001 Campisi ..... 172/439
6,334,269 B1 1/2002 Dilks ..... 37/235
6,381,880 B1 5/2002 Curtis ..... 37/231
6,461,095 B1 * 10/2002 Puska ..... 414/462
6,526,677 B1 * 3/2003 Bloxdorf et al. ..... 37/231
6,609,481 B1 * 8/2003 McCarty ..... 119/843
6,634,588 B1 * 10/2003 Jackson ..... 242/323
6,711,837 B2 * 3/2004 Bloxdorf et al. ..... 37/231

* cited by examiner

FIG. 2
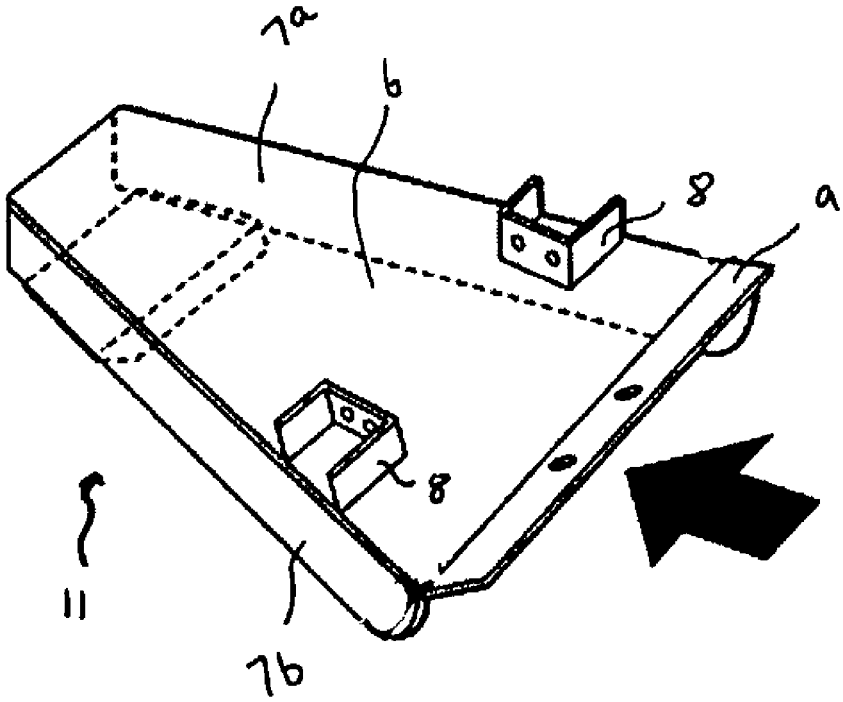
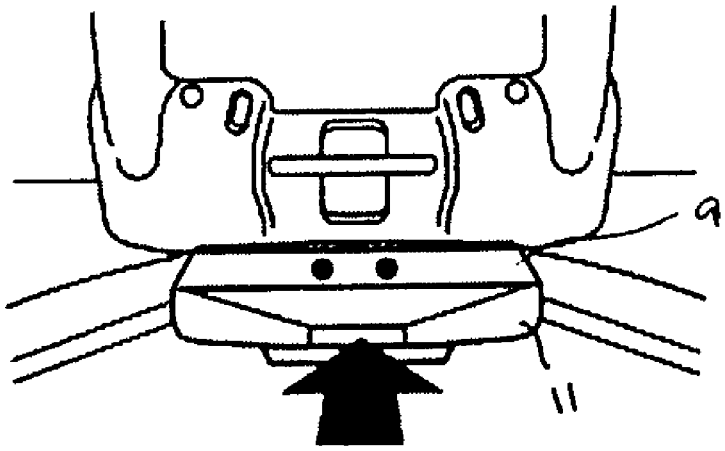
FIG. 3

ALL TERRAIN VEHICLE MOUNT ASSEMBLY FOR A UTILITARIAN ACCESSORY

BACKGROUND OF THE INVENTION

All-terrain vehicles or ATV's are versatile all-season three or four-wheeled motorized vehicles designed for off-road use, including pedestrian and bicycle pathways. Typically ATV's are straddle-type vehicles, where the operator straddles the seat similar to a motorcycle or bicycle. They are generally designed to carry one or two passengers. Although primarily a recreational vehicle, more recently ATV's have been used as utility vehicles. To that end, various utilitarian accessories or implements, such as snow plow blades, can be attached to the ATV. Although the relatively light weight of the ATV allows for the use of small engines, the small engines limit the power capabilities; ATV's generally have a battery and battery recharging system having low amperage storage and low amperage recharging capability relative to a typically automobile. The term "all terrain vehicle" or "ATV" as used herein includes within its scope so-called utility task vehicles or "UTV's", such as the Kawasaki MULE, the John Deere GATOR, the Polaris RANGER and PROFESSIONAL SERIES, the EZ-GO WORKHORSE, the Club Car CARRYALL and PIONEER and the Toro WORKMAN.

Conventional snow blade mounts for four wheel drive vehicles such as pick-up trucks can weigh hundreds pounds (e.g., 750 pounds), and generally include a chassis frame that can be permanently fixed to the vehicle chassis, usually behind the vehicle front bumper. A lift frame is then removably coupled to the chassis frame, and the snow blade is then coupled to the front end of the assembly via an A-frame and trip frame assembly. The A-frame with the snow blade attached is typically removable from the vehicle. Such assemblies, however, are too large and too heavy for practical use with the relatively small ATV.

One drawback of conventional snow blade mounts is the difficulty in readily removing the assemblies from the vehicle chassis, especially in view of their weight. The presence of an implement or accessory on an ATV can render the ATV useless as a recreational all-terrain vehicle. Accordingly, it is highly desirable that the blade be removed after use. However, since the mounting and dismounting operation can be cumbersome and time-consuming, the assemblies are often left on the ATV for the entire winter season.

It is therefore an object of the present invention to provide a utilitarian accessory mounting assembly for an ATV that is conveniently and easily attachable and removable from the vehicle.

It is a further object of the present invention to provide a snow blade assembly for an ATV that is mounted and dismounted from the vehicle using a self-aligning hitch mount devoid of mounting pins.

It is a still further object of the present invention to pivot the utilitarian accessory remotely.

SUMMARY OF THE INVENTION

The problems of the prior art have been overcome by the present invention, which provides a hitch mount assembly for snow blades or other accessories or implements for off-road vehicles such as all-terrain vehicles. The present invention includes an implement assembly readily removably coupled to the vehicle, such as in conjunction with a receiver that is mounted to the vehicle chassis or frame or is integrated therewith. The configuration of the receiver and implement assembly allows for self-alignment during the mounting operation. A switching mechanism and actuator also can be used to pivot the working implement remotely.

In one embodiment, a power winch is used to mount the assembly to the ATV. The winch is also used to vertically raise and lower the working implement relative to the ground. In another embodiment, the relatively light-weight of the assembly allows the assembly to be mounted to the ATV manually, without the use of a winch or other power-operated tool, simply by pushing the assembly towards the ATV or by driving the ATV towards the assembly.

BRIEF DESCRIPTION OF THE DRAWINGS

FIG. 2 is a perspective view of a receiver in accordance with the present invention;

FIG. 3 is a front view of the receiver of FIG. 2 shown mounted to the chassis of an ATV;

FIG. 6A is a view of a lift handle for manual actuation of a blade;

DETAILED DESCRIPTION OF THE INVENTION

Figure 1:
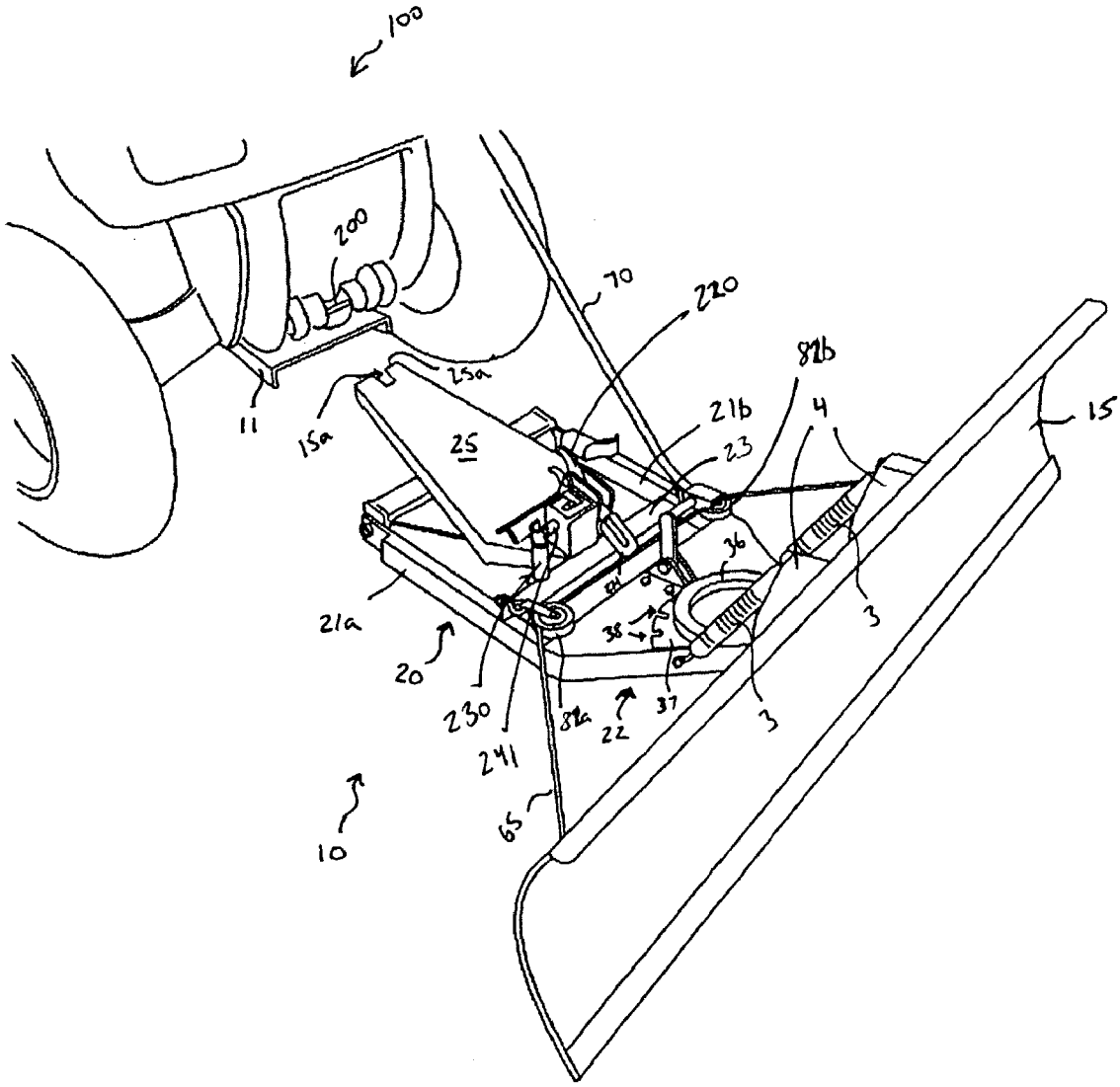
FIG. 1 is a perspective exploded view of a snow blade mounting assembly in accordance with the present invention.

Turning first to FIG. 1, there is shown generally at 10 the blade and hitch assembly in accordance with a preferred embodiment of the present invention. The assembly 10 is relatively lightweight, preferably weighing between about 50 and about 300 pounds, and is most preferably sufficiently light to enable a single individual to slidingly push the assembly into mounting engagement with the receiver on the vehicle. Thus, its various components can be constructed of metal, steel, stainless steel, plastics or composites, for example, depending upon the relative strength required of each component. Vehicle mounted receiver 11 attaches to the vehicle chassis or frame, or is integrated therewith. Any suitable means can be used to secure the receiver 11 to the vehicle, such as bolting or manufacturing integration (e.g., as a stamped component of the vehicle chassis or frame) For example, as shown in FIG. 2, the receiver 11 can include a pair of U-shaped flanges 8 with holes for coupling the receiver to the vehicle chassis. The design of the receiver 11 interface for attachment to the chassis will depend upon the identity (and thus design) of the particular chassis, and is well within the skill in the art. Because in the embodiment shown the receiver 11 is situated under the chassis and is not obtrusive, it optionally can be permanently affixed to the chassis, regardless of whether the snow plow blade or other accessories or working implements are attached or in use. Alternatively, the receiver can be located on the vehicle frame where it does not extend below the frame so as to provide adequate ground clearance. It is fixed and preferably has no moving parts; its main purpose being to provide a means of attachment of the follow-on components. It also can absorb and transfer any shock loads imposed on the snow blade (or other accessory) into the vehicle. It can be made of any rigid material suitable for the job, such as steel, metal, stainless steel, plastic or composites, for example.

As best seen in FIGS. 2 and 3, the receiver 11 is preferably trapezoidal in shape, uniformly tapering inwardly from its open front end towards the rear. It has an optional top plate 6, with opposite vertically depending side guides 7*a* and 7*b* as shown. Alternatively, the sides 7*a* and 7*b* could be independently attached directly to the chassis, directly to the frame, or integrated therewith, preferably defining between them a trapezoidal wedge. A front upwardly angled lip 9 is optionally provided at the receiver entry to assist in guiding the implement to be mounted into the receiver 11, in the direction of the arrows shown in FIGS. 2 and 3. The sides 7*a*, 7*b* are in a tapered profile such that the distance between them decreases in the direction towards the vehicle rear when mounted thereto.

Turning back to FIG. 1, the blade and hitch assembly 10 is adapted to be releasably coupled to or engaged by the receiver 11. In the embodiment shown, a blade 15 is illustrated as the utilitarian accessory or working implement, although those skilled in the art will appreciate that the present invention is not limited to mounting and dismounting of a blade. The blade 15 can be conventional in design. The preferred blade is made of sheet metal, or is a sheet of steel bumped or rolled to a semi-round shape. The blade 15 also can be in the form of an adjustable V-shaped blade. The blade is braced on the backside with a plurality of mounts 4 providing a means of attachment (such as via springs 3) to the support frame 20.

Figure 7:
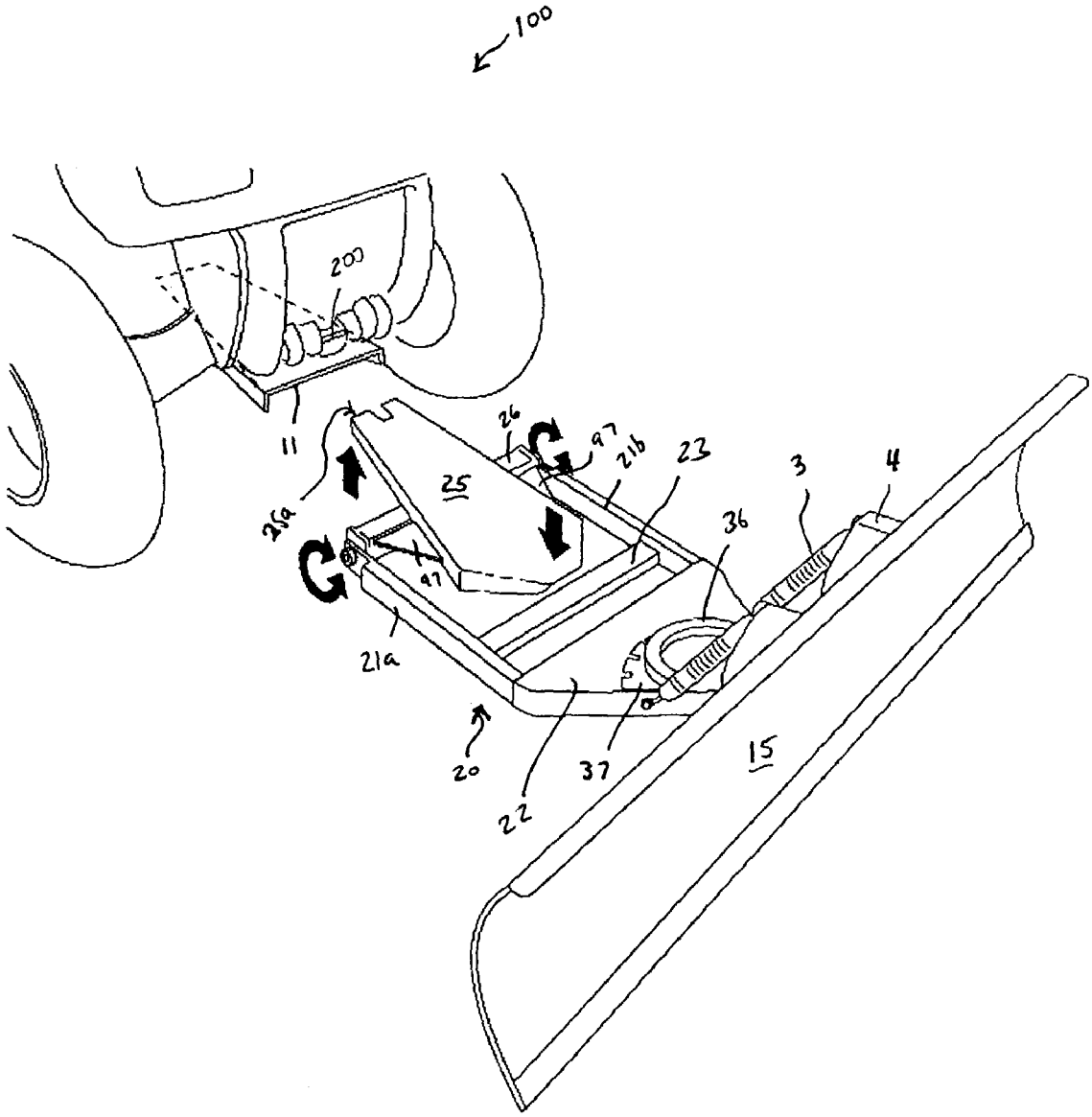
FIG. 7 is a perspective view of a portion of the mounting assembly in accordance with the present invention.
Figure 8:
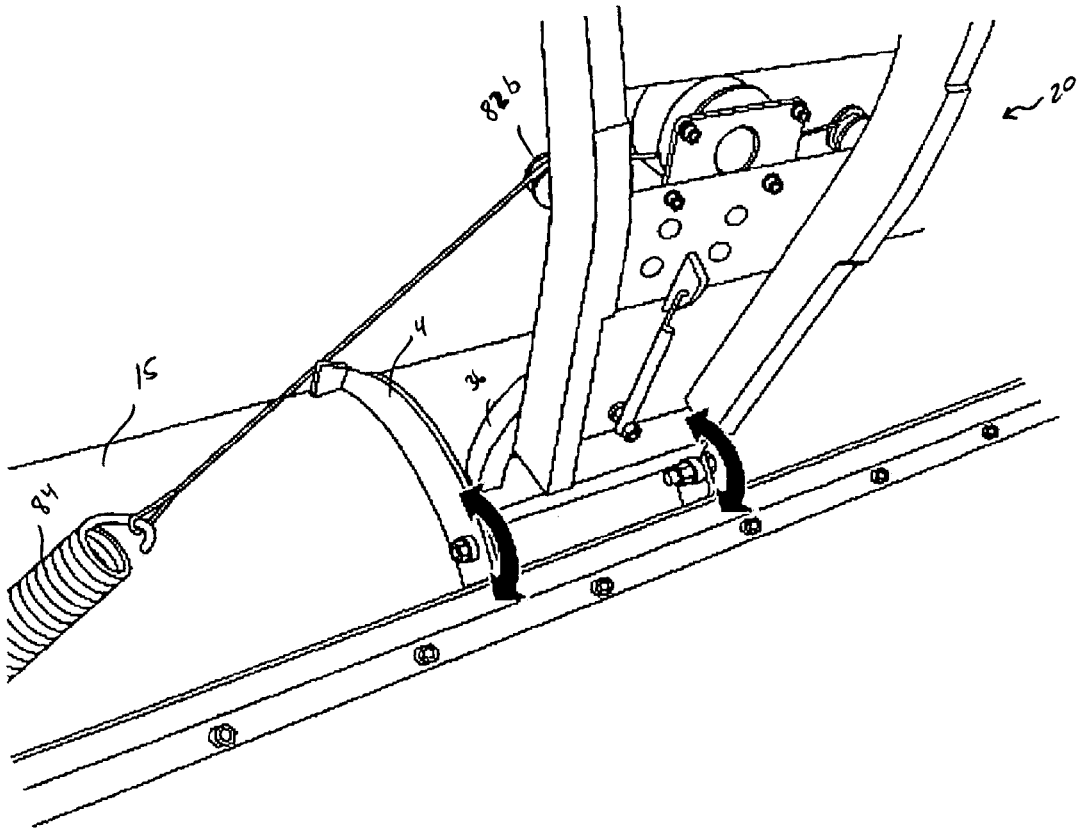
FIG. 8 is a perspective bottom view of the blade shown attached to the A-frame in accordance with the present invention.

As best seen in FIGS. 7 and 8, support frame 20 includes opposite side members 21*a*, 21*b* that preferably are bent along their lengths to define an A-frame portion 22. The A-frame portion tapers towards an apex that can be pivotably coupled directly to the blade 15, or is attached to the blade 15 through a trip flame assembly as discussed in greater detail below. Those skilled in the art will appreciate that although the term "A-frame" is used herein, the frame need not be in the shape of an "A". Male hitch member 25 is coupled to a pivotable cross bar 26 (such as by welding to ears 97) that is pivotably supported between opposite sides 21*a*, 21*b*. At least a portion of the hitch member 25 corresponds in shape to receiver 11, so that that portion of the hitch member 25 can be slidingly engaged by receiver 11 during the mounting operation. Thus, in the preferred embodiment, hitch member 25 has a trapezoidal portion, which tapers outwardly from the free end 25*a* in the direction towards the implement 15. In the embodiment shown, the taper extends to a maximum and then tapers inwardly to the opposite end of the member 25. Those skilled in the art will appreciate that the free end of the hitch member 25 can be formed as two or more extensions rather than a single continuous end as shown. The hitch member 25 and cross bar 26 pivot about a horizontal axis, preferably about 200 from horizontal in each direction.

Figure 4:
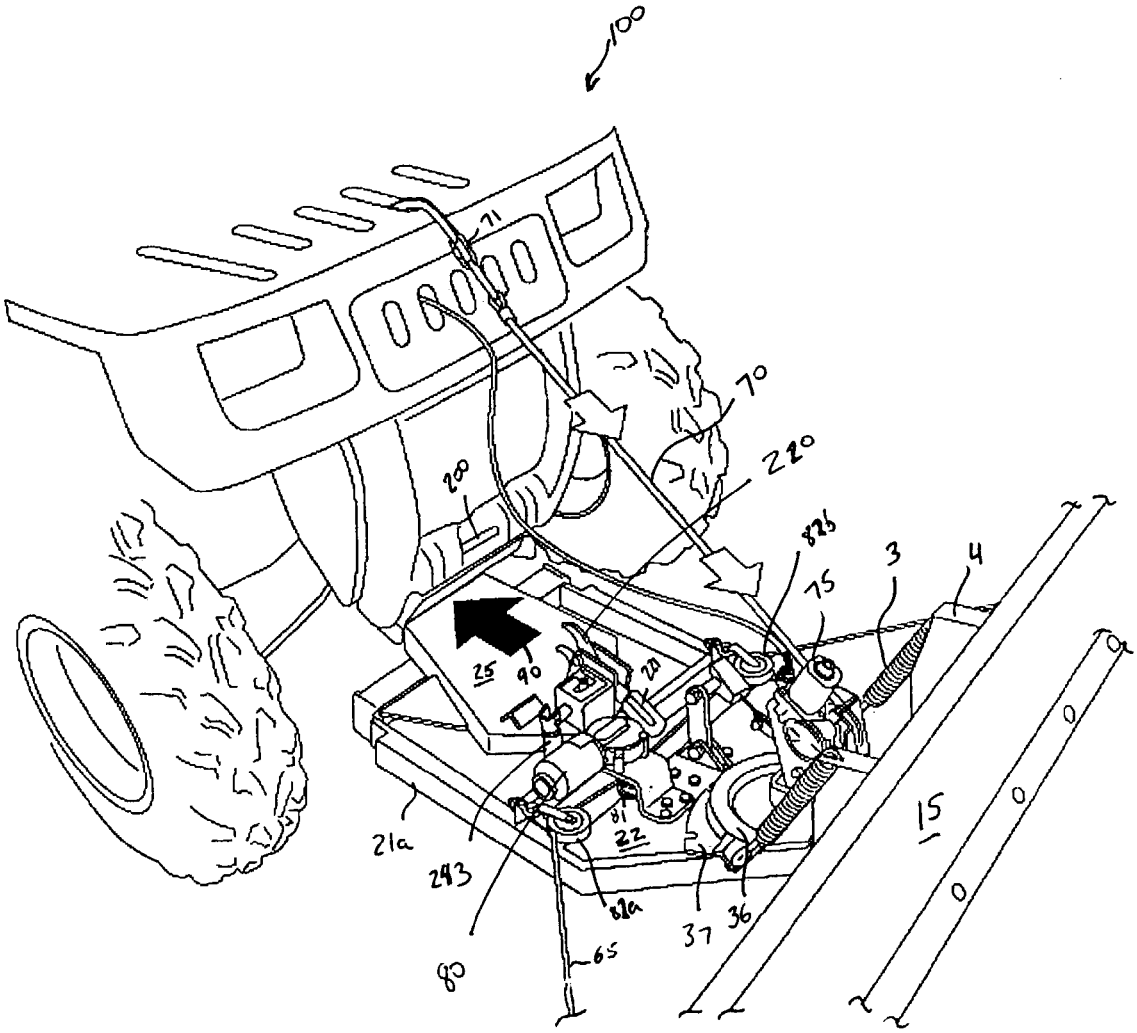
FIG. 4 is a perspective view of a snow blade mounting assembly shown partially mounted to an ATV in accordance with the present invention.
Figure 5:
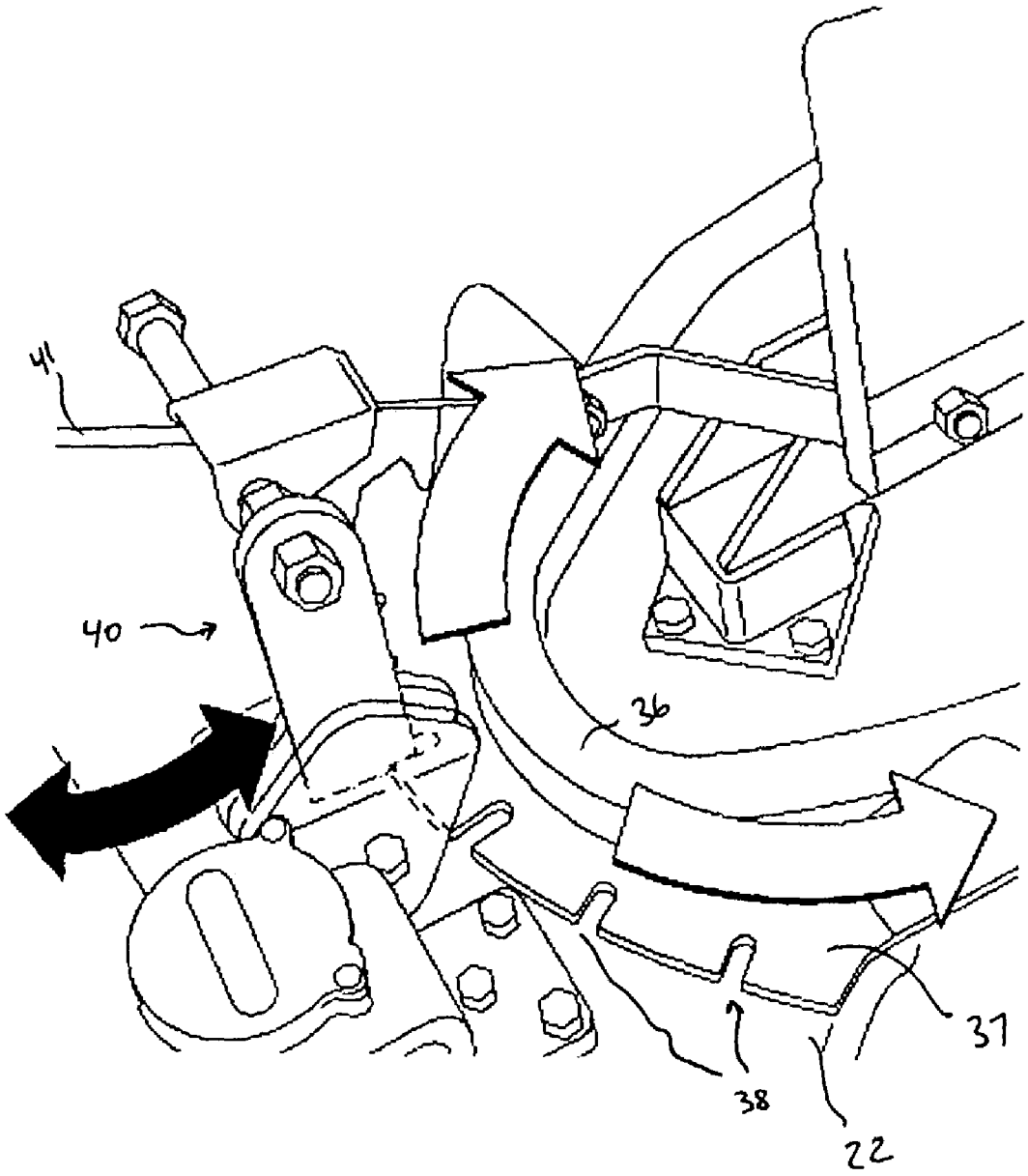
FIG. 5 is a perspective view of the blade pivoting mechanism in accordance with the present invention.

Turning now to FIG. 4, an optional trip frame assembly is shown that includes half-ring or A-frame retainer 36 supported on the top surface of the A-frame 22. Those skilled in the art will appreciate that the half-ring 36 can be designed having shapes other than that shown. The trip frame assembly is connected to the blade 15 via springs 3 (two shown). The trip frame assembly allows the blade 15 to pivot forward, which allows it to trip over obstacles and absorb shock that would otherwise be transferred into the plow frame assembly and vehicle, which in extreme cases would cause substantial damage. If the trip frame assembly is eliminated, the blade can have a conventional trip edge as known in the art.

Extending from the half-ring or retainer 36 is a notched plate 37, also supported on the A-frame 22 top surface, to set the blade angle. The plate 37 has a plurality of spaced notches 38 extending around the annular edge of the plate 37 as shown. As the blade 15 pivots, the notched plate 37 also pivots, and can be locked in place with locking mechanism 40 that, when properly aligned with a notch 38, inserts into that notch 38 to prevent movement of the plate (and thus the blade 15) until it is retracted from the notch.

Figure 9:
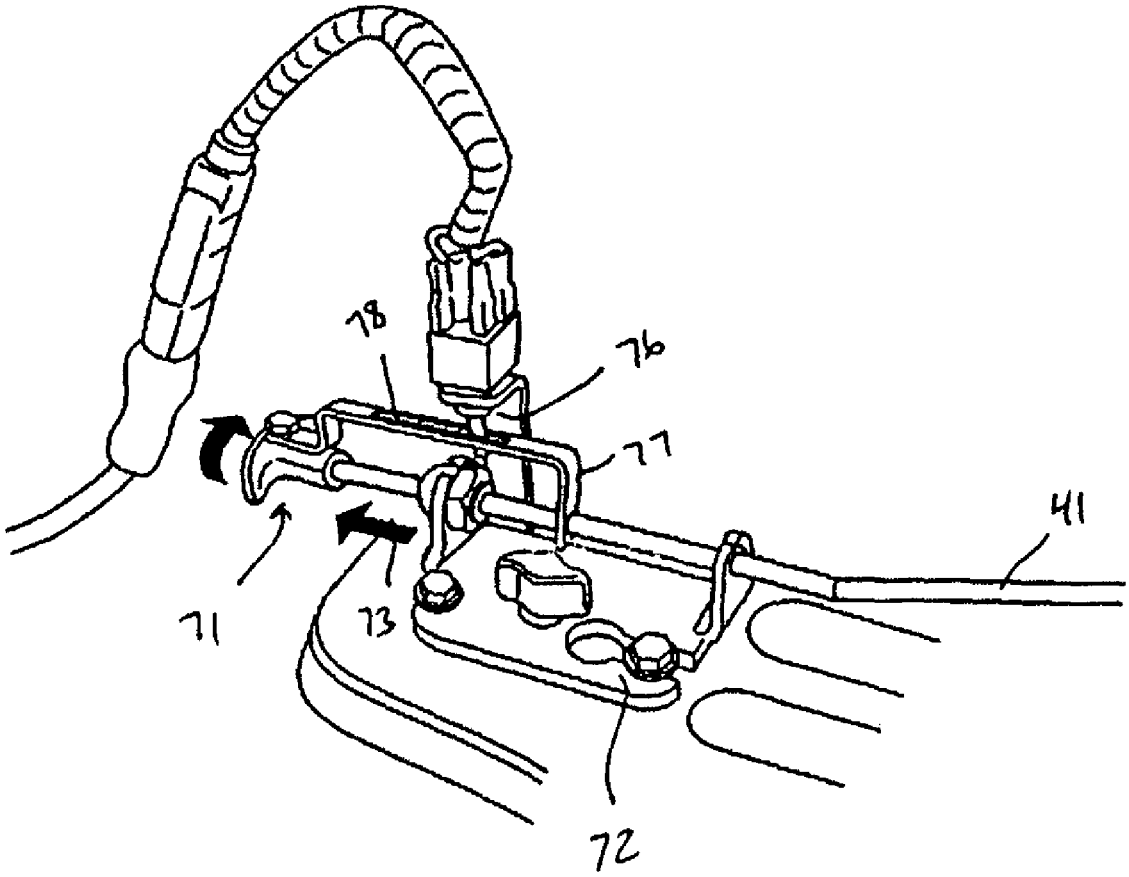
FIG. 9 is a perspective view of the accessory actuator in accordance with the present invention.

One suitable mechanism for actuating the locking mechanism uses cable 41 extending from the locking mechanism 40 to a location where it is readily accessible by the driver of the ATV. By tensioning the cable 41 by drawing it towards the vehicle rear, such as with remote control actuator 71 (FIG. 9), the locking mechanism is disengaged from the notch 38, allowing the blade to pivot. More specifically, actuator 71 is slidably mounted in cable bracket 72 as is conventional in the art. By pulling actuator towards the vehicle rear, in the direction of arrow 73, the cable 41 is tensioned and the locking mechanism is unlocked, allowing the blade 15 to freely pivot. Once the blade 15 is positioned as desired, the tension on the cable 41 is released by releasing the actuator 71, allowing the locking mechanism to again latch into a notch 38 and lock the blade in place. Those skilled in the art will appreciate that the locking mechanism can be operated manually.

Figure 10:
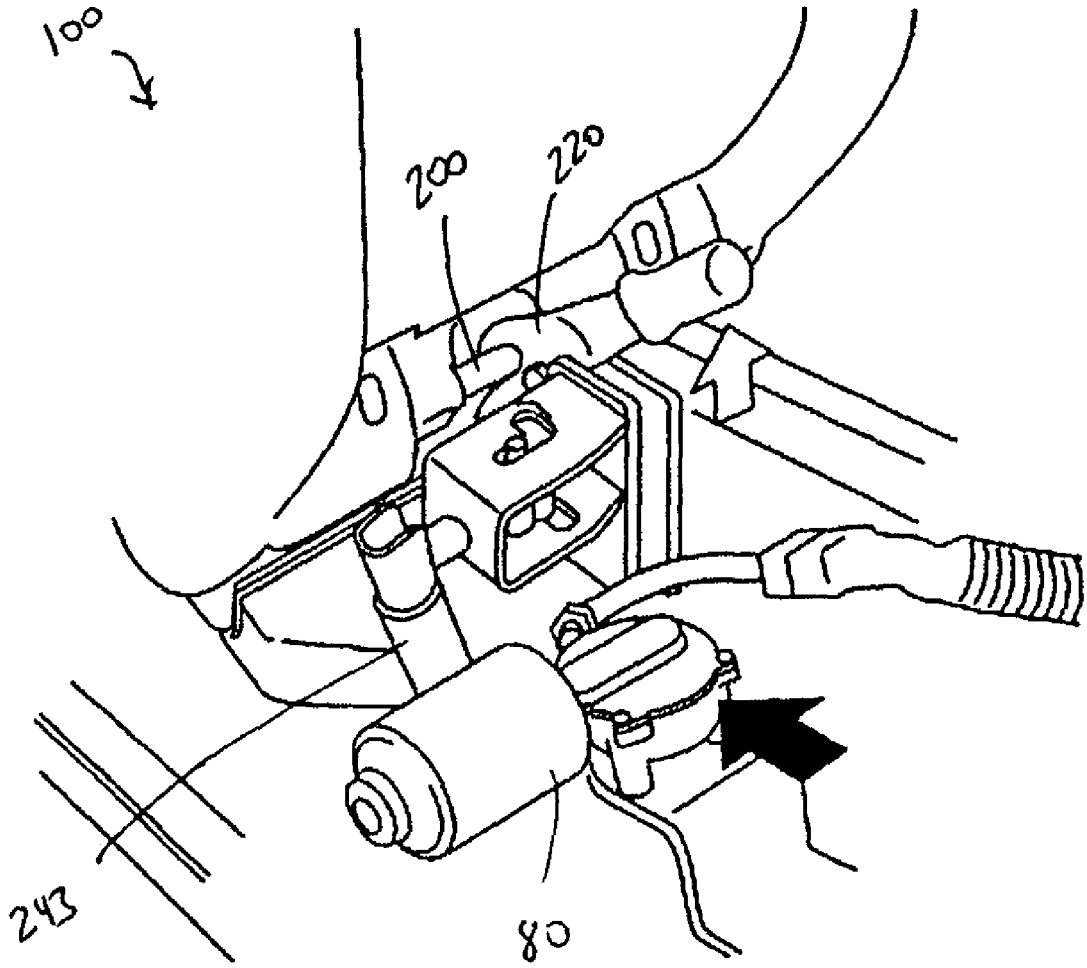
FIG. 10 is a perspective view of the motor for pivoting the accessory in accordance with the present invention.
Figure 11:
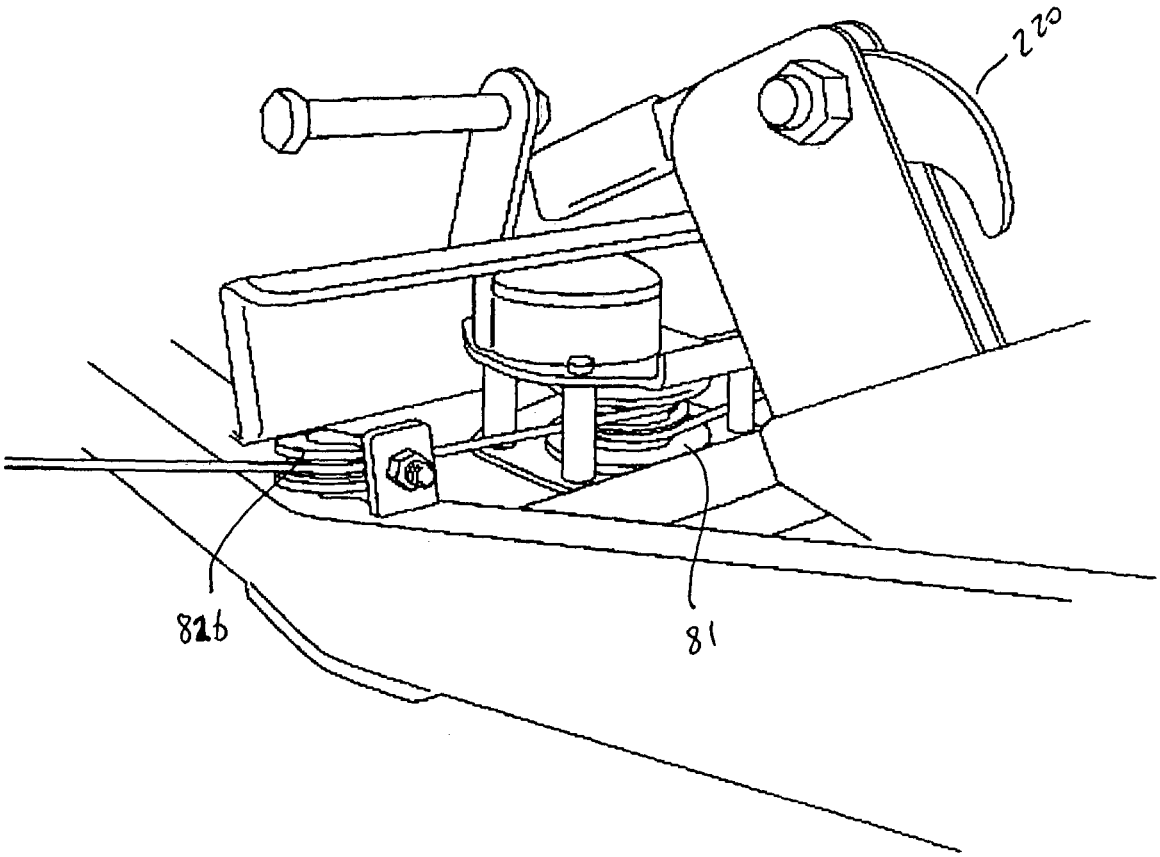
FIG. 11 is a partial perspective view of the spool and cable assembly in accordance with the present invention.
Figure 12:
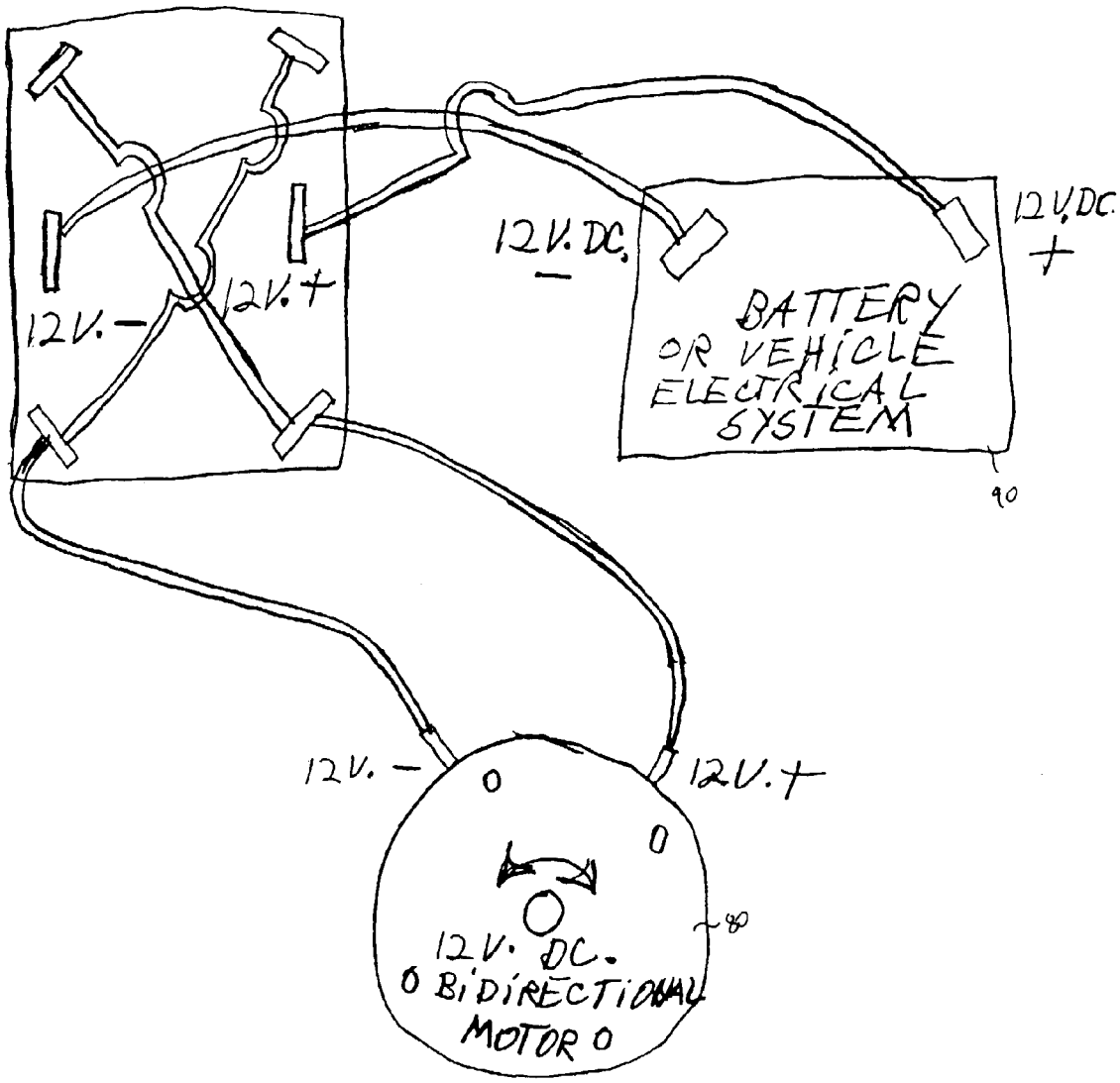
FIG. 12 is a schematic diagram of the switching system in accordance with the present invention.

Proper angling of the blade 15, when the blade is in a freely pivotable position, was conventionally accomplished manually, requiring the operator to leave the vehicle and physically pivot the blade. Alternatively, the operator would drive the blade into a stationary object, such as a tree, to pivot the blade. Either method was tedious and inconvenient. In accordance with one embodiment of the present invention, the blade angle preferably is controlled remotely, such as by the driver of the ATV when seated on the ATV in the driving position. Thus, the remote actuator 71 can be used not only to unlock the blade 15 as discussed above, but also to remotely pivot the blade. To that end, remote actuator 71 is modified with slotted member 77 that receives switch 76 in slot 78. Switch 76, such as rocker or toggle switch, is in electrical communication with a bi-directional motor 80 (FIGS. 4 and 10). It is preferably a double pole, double throw three-position switch, the center being the off position and the other two positions being momentary (FIG. 12 shows a suitable schematic of the switch). The motor 80 is preferably powered by the vehicle battery 90 and reversibly drives drum or spool 81 (FIG. 11) wrapped with two separate cables; one threaded through pulley 82*a* and secured at or near an end of the blade 15, and the other threaded through pulley 82*b* and secured at or near the other end of blade 15. The attachment of each cable to the blade 15 can be a direct attachment, or a spring 84 (FIG. 8) can be positioned between the blade and the cable for added play.

To pivot the blade 15, the operator draws actuator 71 in the direction of arrow 73 to unlock the blade. The actuator is then rotated to the left or to the right, depending upon the desired angle of the blade, thereby actuating switch 76 which engages the motor 80, driving spool 81. When driven in one direction, the spool 81 deploys one cable and reels in the other, and when driven in the other direction, the opposite cables are deployed from and reeled onto the spool, respectively. The deploying or reeling in of cable pivots the blade accordingly. Once the blade is in the desired position, the actuator is rotated back to the normal position, which corresponds to the center position of the switch 78, and is then released to lock the blade in place. Those skilled in the art will appreciate that the actuator for power angling of the blade need not be the same actuator used to unlock the blade from its fixed position; separate actuators can be used to accomplish these operations.

Figure 2A:
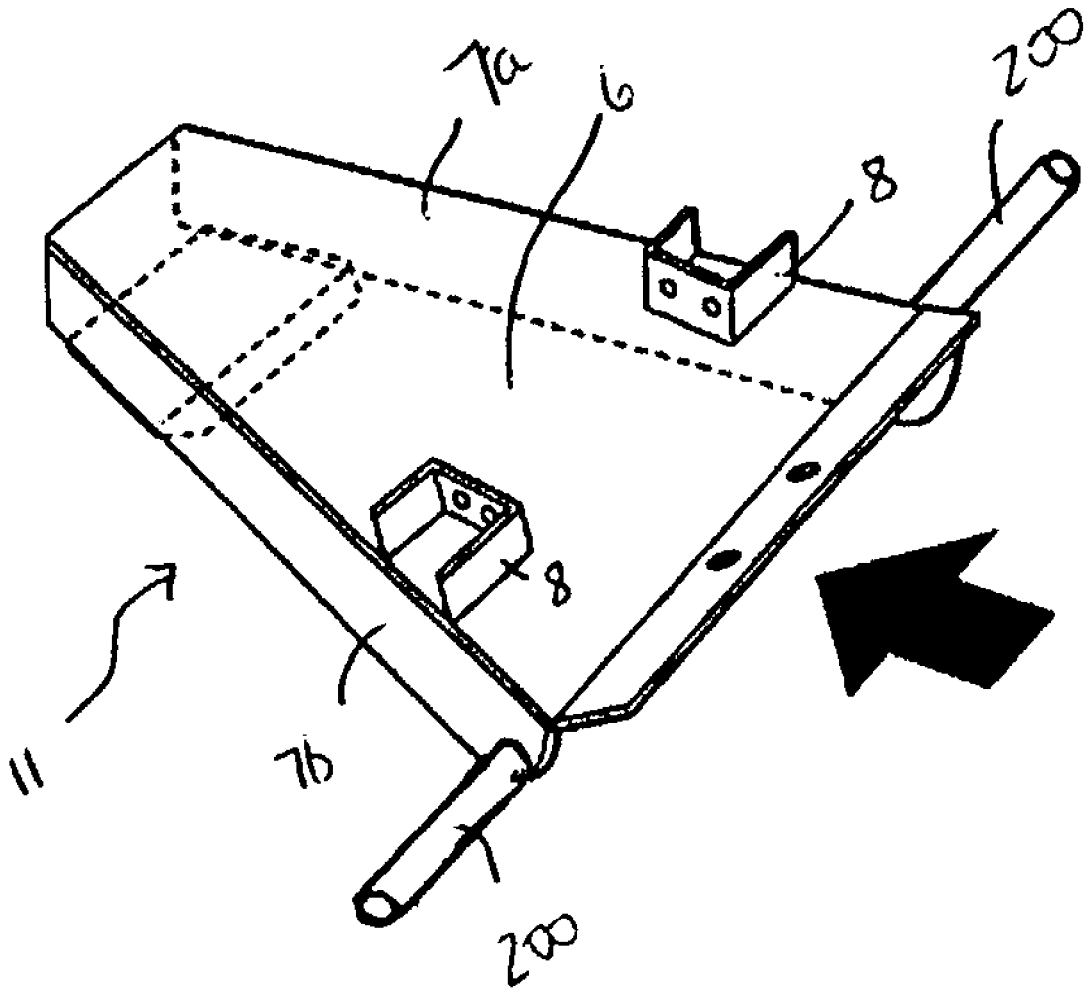
FIG. 2A is a perspective view of a receiver in accordance with another embodiment of the present invention.

Further details will now be provided regarding the hitch mount of the present invention. As discussed above, receiver 11, preferably made of ⅜" mild steel, is attached to the vehicle by suitable means or is integrated therewith such as during manufacturing of the vehicle. Conveniently, some conventional ATV's come equipped with a round bar or rod 200, solid or tubular, and generally about ⅜ to ½" in diameter, secured to the vehicle front (FIG. 1). In the embodiment shown in FIGS. 4 and 7, the bar 200 extends horizontally a distance sufficient to be engaged at or near its opposite ends by one or more latch hooks 220 discussed in detail below. Those skilled in the art will appreciate that the bar 200 could be vertical or angled, and need not be continuous; two or more separate bars could be used such as at each end of the receiver 11 (FIG. 2A), as long as they are appropriately positioned for engagement by one or more latch hooks 220. In addition, the bar need not be round; other shapes corresponding to the receiving shape of the latch hook could be used. Preferably the bar or bars are located above the plane of the receiver 11. The receiver 11 need not be positioned directly under the bar or bars; the bar or bars could be positioned radially outwardly of the receiver 11 such as shown in FIG. 2A.

In ATV's where the rod 200 is not original equipment, it can be added. For example, as shown in FIG. 2A, the bar 200 can be part of the receiver 11, as one continuous bar or as two or more separate bars. Again, the bar(s) could be vertical or angled with respect to horizontal, and need not be positioned directly over the receiver 11. Where two or more separate bars are used, they are preferably positioned in the same plane. In the embodiment of FIG. 2A, there are two bars that each terminate in opposite free ends.

Receiver 11 includes generally longitudinally extending (in the direction from the vehicle front to the vehicle rear) side guide members 7*a*, 7*b* as discussed above, which help ensure proper alignment of the hitch assembly. The spacing or volume or distance between these guide members is configured to accommodate the male hitch 25 pivotably coupled to the frame 20. Thus, in the embodiment shown, the hitch member 25 is tapered such that the length of its free engaging end 25*a* is relatively short, and expands in the direction towards the implement 15. Similarly, sides 7*a*, 7*b* are configured and placed such that the receiver volume is tapered, with its end farthest from the vehicle front being shorter than the end closest to the vehicle front. The sides 7*a*, 7*b* thus act as a track for receiving and aligning hitch member 25. Free end 25*a* of hitch member 25 can be formed with a notch 15*a* (FIG. 1) to ensure that the hitch member 25 clears the nut and bolt that attaches the receiver 11 to the vehicle chassis. Those skilled in the art will appreciate that two or more receivers 11 can be used, in which case two or more hitch members would be used.

Figure 6:
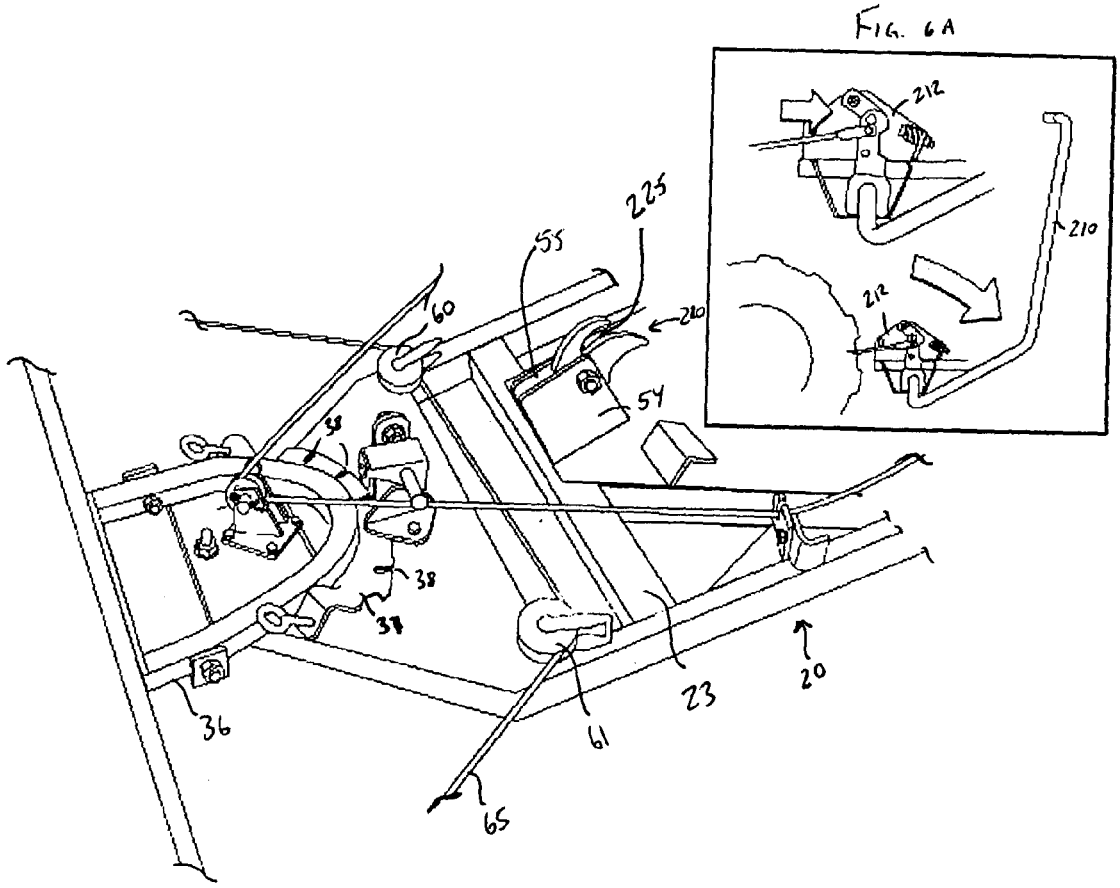
FIG. 6 is a perspective view of a portion of the mounting assembly in accordance with the present invention.
Figure 13:
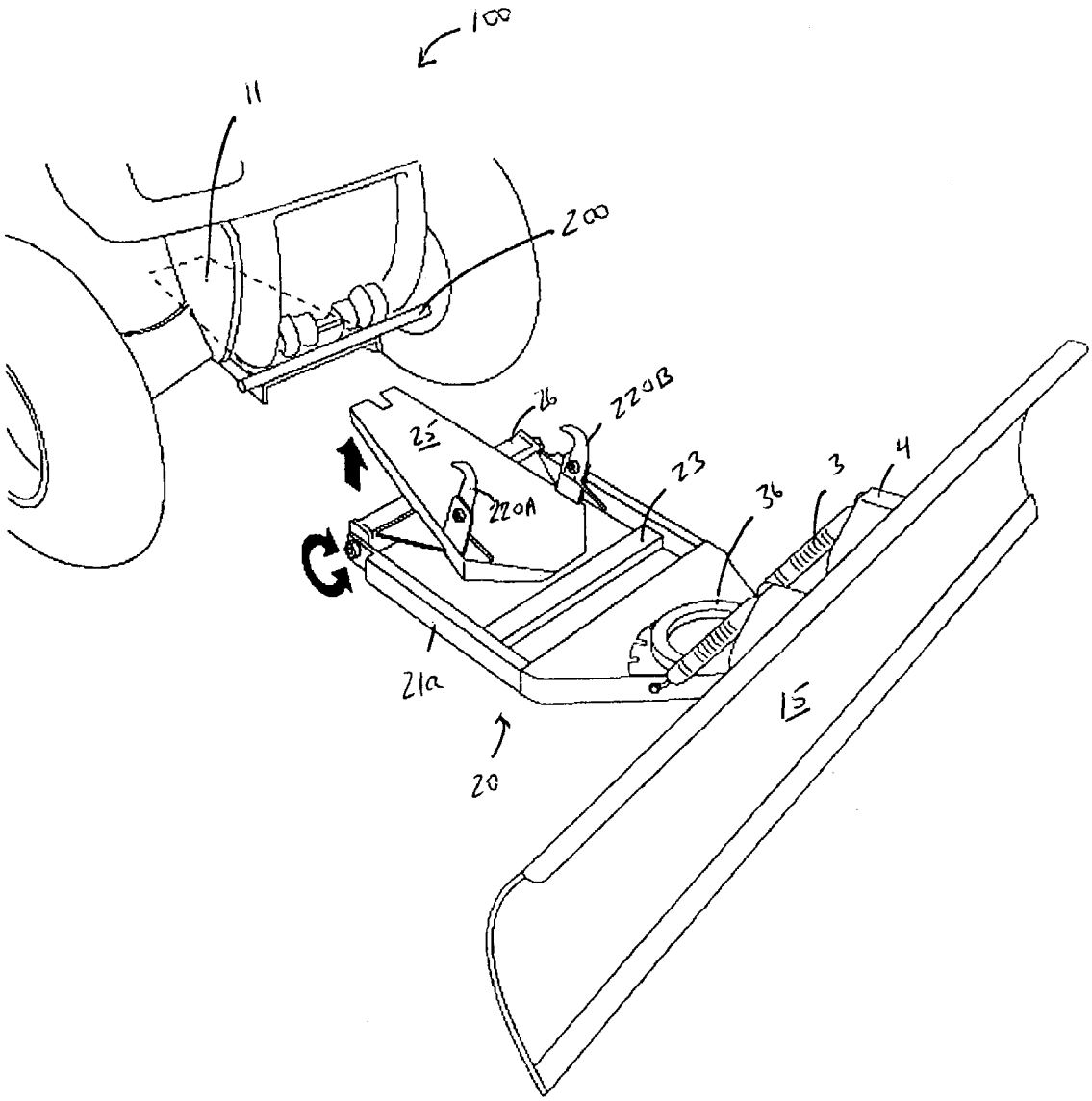
FIG. 13 is a perspective view of a portion of the mounting assembly in accordance with another embodiment of the present invention.

Pivotally coupled to spaced side brackets 54, 55 via a pivot shaft is a latch 220, which in the embodiment shown, is centrally located on cross bar 23 (FIG. 6). The side brackets 54, 55 are spaced a sufficient distance to accommodate the latch 220 and allow for its movement. Although only one latch 220 is necessary, multiple latches could be used and are within the scope of the present invention. One such embodiment is illustrated in FIG. 13, where two opposite and aligned latches 220A, 220B are shown. Where multiple latches are used, the latches 220 can share a common pivot shaft, the pivot shaft extending from one latch to the other so that movement of the latches is coordinated; actuation of one latch results in a corresponding movement of the other latches. Alternatively, the multiple latches can be actuated separately.

Each latch 220 preferably has a hook shape including an arcuate recess 225 corresponding in angle to the circumference of the bar 200. The latch is thereby adapted to receive bar 200. Preferably the recess is shaped as a concentric cam, so that upon contact with the bar 200, the latch 220 can automatically pivot to a closed position, locking onto the bar 200. This design facilitates the grasping and interlocking of bar 200 as well as the dismounting operation. The latch 220 can include a handle 221 for manual actuation for use such as in the event the latch does not properly lock onto the bar 200. A latch locking assembly 230 (FIG. 1) optionally can be used to lock the latch in place. One suitable locking assembly includes a spring loaded pin assembly, with spring biasing against a pin 241. In the locked position, the spring forces pin 241 through an appropriately dimensioned aperture in the latch, thereby fixing the latch 220 in place. Lever 243, shown in FIG. 4 in the locked (orthagonal) position, prevents pin 241 from retracting out of the aperture. In the unlocked position, the pin is retracted from the aperture, allowing movement of the latch for engagement or disengagement of the hitch.

The preferred method for attaching the hitch mounting assembly to the ATV will now be described with particular reference to FIG. 4. The vehicle 100 is positioned close to the hitch mounting assembly, and one end of a tether 70, such as a rope, chain, cable, wire, links, etc., is attached to the vehicle 100 preferably at a location higher (to later facilitate lifting of the blade) than the mounting assembly. Most ATV's come equipped with a utility hook or clamp 71 coupled to a rope permanently attached at or near the top of the ATV body. This or any other convenient location typically at or near the front of the ATV can be used as the point of attachment of one end of the tether 70. In ATV's where the clamp 71 is not original equipment, it can be added or another point of attachment can be used. The tether 70 is also attached to an actuator 75 such as a winch mounted on the mounting assembly, such as on the A-frame or on the working implement itself. In the embodiment shown, the winch 75 is electrically driven by the motor of the ATV, although it is within the scope of the present invention for the which to be powered separately. Actuation of the winch causes the tether to be reeled onto the spool of the winch, in turn causing the mounting assembly to be pulled towards the vehicle 100. The free end of the hitch member 25 is thus pulled towards receiver 11 in the direction of arrow 90. In view of the corresponding shapes of the receiver 11 and hitch member 25, the mounting assembly properly aligns with the vehicle 100 as the hitch member 25 is engaged by the receiver 11. As the tether continues to wrap around winch 75 and pull the mounting assembly towards the vehicle, the hitch member 25 continues to progress into receiver 11, until latch 220 engages bar 200. The engagement of the latch with the bar causes the latch to pivot into a closed position about the bar. The locking assembly is then actuated (either automatically, or manually via lever 243) to secure the latch in place. Continued actuation of the winch raises the blade, and thus the winch can be used during operation of the vehicle to raise and lower the blade. Alternatively, the blade can be raised and lowered in a conventional manner, such as manually with a lift handle 210 (FIG. 6A) positioned rearwardly of the blade, the lift handle 210 being pivotally mounted on a bracket 212 and connected to a bell crank to vertically lift or lower the blade. Such manual actuation of the blade is disclosed in U.S. Pat. No. 5,615,745, the disclosure of which is hereby incorporated by reference. In the embodiment shown, in the latched position the recess of the latch 220 faces downwardly towards the ground, although the latch 220 can be designed so that the recess faces upwardly.

Alternatively, the assembly can be mounted to the vehicle manually. In view of the design of the hitch member 25 and corresponding receiver 11 and the relatively light weight of the hitch assembly, the assembly can be simply "pushed" into mounting relationship by one or more individuals without the use of the winch. For example, an individual can stand in front of the working implement, place his hands on the implement, and slide the assembly 10 towards the receiver 11, allowing the hitch member to enter the receiver 11 and progress towards the rear thereof until the latch or latches engages bar or bars 200.

To remove the hitch mounting assembly from the vehicle chassis, the locking pin is released, and the lever 221 optionally is placed in the down position. Upon separating the vehicle from the assembly (such as by driving the vehicle away from the assembly or by manually pulling the assembly away from the vehicle), the latch moves away from the bar 200, disengaging the same and actually pushing the receiver 11 away from the assembly. The electrical and mechanical connections are then disconnected to complete the dismount.

Alternatively still, the assembly can be mounted to the vehicle by driving the vehicle towards the assembly, and in particular, towards the free end of the hitch member 25 so that it can be received by the receiver 11. As the mounting progresses, the latch or latches engage the bar 200 and are locked in place. To facilitate the mounting and minimize or prevent the assembly from moving away from the vehicle as it is engaged by the receiver, the assembly can be temporarily fixed in place, such as by positioning it in front of an obstruction.

Those skilled in the art will appreciate that although the foregoing illustrates a front-mounted assembly, mounting the same to the rear of the vehicle is within the scope of the present invention.

What is claimed is:

1. A method of attaching a hitch mounting assembly to an all terrain vehicle having a receiver and at least one bar, said hitch mounting assembly comprising a frame supporting a working implement, a hitch member pivotable about a pivot axis, said hitch member having a free end adapted to be received by said receiver, and at least one latch for engaging said at least one bar, said method comprising:

attaching with a tether said hitch mounting assembly to said vehicle;

tensioning said tether to draw said hitch mounting assembly towards said vehicle, causing said hitch member to be slidingly received by said receiver and said at least one latch to engage said at least one bar.

2. The method of claim 1, wherein said hitch mount further comprises a winch having a drum, and wherein said tether is attached to said drum and is tensioned by actuating said winch and causing said tether to wrap around said drum.

3. The method of claim 1, wherein there are two bars and two latches.

4. The method of claim 1, wherein said working implement is a blade.

5. The method of claim 1, further comprising angling said working implement about a vertical axis.

6. The method of claim 2, further comprising actuating said winch to raise or lower said working implement.

* * * * *